United States Patent [19]

Meadows

[11] 4,121,221

[45] Oct. 17, 1978

[54] RADIO FREQUENCY ARRAY ANTENNA SYSTEM

[75] Inventor: Lee A. Meadows, Santa Barbara, Calif.

[73] Assignee: Raytheon Company, Lexington, Mass.

[21] Appl. No.: 777,484

[22] Filed: Mar. 14, 1977

[51] Int. Cl.[2] ..... H01Q 3/26; H01Q 21/00

[52] U.S. Cl. ..... 343/854; 343/853

[58] Field of Search ..... 343/854, 100 TD, 100 LE, 343/853

[56] References Cited

U.S. PATENT DOCUMENTS

| | | | |
|---|---|---|---|
| 3,435,453 | 3/1969 | Howard | 343/854 |
| 3,806,932 | 4/1974 | Dietrich et al. | 343/854 |
| 3,916,417 | 10/1975 | Wong et al. | 343/854 |

*Primary Examiner*—Alfred E. Smith
*Assistant Examiner*—Harry E. Barlow
*Attorney, Agent, or Firm*—Richard M. Sharkansky; Joseph D. Pannone

[57] ABSTRACT

A radio frequency array antenna system wherein an array of antenna elements in a multibeam array antenna is coupled to one of a pair of beam forming networks and a portion of such antenna elements is coupled to another one of the pair of beam forming networks. Radio frequency amplifiers are coupled between the array of antenna elements and the pair of beam forming networks. The beam forming network which is coupled to only a portion of the antenna elements is used in the transmission of continuous wave radio frequency energy and the other beam forming network is used in the transmission of pulsed radio frequency energy. During transmission of the continuous wave energy only the portion of the radio frequency amplifiers coupled to the corresponding beam forming network is powered and during transmission of pulse modulated radio frequency energy all of the radio frequency amplifiers are supplied with power. With such arrangement the power required for the multibeam array antenna system is reduced and activation of the radio frequency amplifiers which are used to transmit pulsed energy produces minimum intermodulation of continuous wave energy being transmitted.

5 Claims, 11 Drawing Figures

81
85
83
87

THRESHOLD DETECTOR 80 OUTPUT
0
TIME

LOW PASS FILTER 82
86

THRESHOLD DETECTOR OUTPUT 84

COUNTER OUTPUT 90
95
T

AND GATE 119

COMPARATOR 92 OUTPUT (LINE 100 CW)

LINE 100 PULSE

LINE 100 NO SIGNAL

RADIO FREQUENCY ARRAY ANTENNA SYSTEM

BACKGROUND OF THE INVENTION

This invention relates generally to radio frequency array antenna systems and more particularly to multi-beam array antenna systems adapted to form a plurality of simultaneously existing beams of energy, selected one or ones of such beams being associated with continuous wave (CW) radio frequency energy and selected one or ones of such beams being associated with pulsed radio frequency energy.

As is known in the art, an array antenna may be arranged so that it produces a plurality of simultaneously existing beams of radio frequency energy. One such antenna is described in U.S. Pat. No. 3,761,936, Multi-Beam Array Antenna, inventors Donald H. Archer, Robert P. Prickett and Curtis P. Hartwig, issued Sept. 25, 1973 and assigned to the same assignee as the present invention. As described therein, the array antenna is adapted to produce a plurality of simultaneously existing beams of radio frequency energy, each one of the beams having the gain and bandwidth of the entire aperture. Such array antenna has a wide application such as in a relay or transponder as described in U.S. Pat. No. 3,715,749, Multi-Beam Radio Frequency System, inventor Donald H. Archer, issued Feb. 6, 1973 and assigned to the same assignee as the present invention. As described therein, in one application a pair of multi-beam array antennas is used, one for reception and one for transmission. Radio frequency energy along a particular wavefront is focused to a particular output port of the array, detected, fed to a corresponding input port of the transmitting array and retransmitted back along the same direction as the received wavefront.

In many applications it is required that the transmitted radio frequency energy be either pulsed radio frequency energy, continuous wave (CW) radio frequency energy or both superimposed one on the other, i.e. pulse and CW energy simultaneously. Further, it is often desirable to transmit pulsed ratio frequency energy in one beam and continuous wave (CW) radio frequency energy in a different beam. Thus, for example, in response to the detection of a continuous wave energy signal it may be desired to transmit a pulsed radio frequency energy signal along the direction of the received signal or along some other direction; or alternatively, to transmit continuous wave radio frequency energy in response to the detection of pulsed radio frequency energy; and so forth.

One arrangement suggested to provide these features includes the use of a single beam forming network such as a radio frequency parallel-plate lens having output ports coupled to an array of antenna elements through radio frequency amplifiers, such as traveling wave tubes (TWT), and having input ports of the network coupled to a continuous wave (CW) radio frequency energy source. When it is desired to transmit pulse modulated radio frequency energy signals the desired modulation is applied to the relatively low power CW energy source feeding the input ports. The radio frequency amplifiers are powered full time to amplify the signals fed thereto. The arrangement requires that the radio frequency amplifiers operate full time, i.e. in a one hundred percent duty cycle, thereby requiring relatively large amounts of power and therefore a power supply having relatively large weight, volume and cost. Another suggestion is to pulse modulate the radio frequency amplifiers when pulse modulated energy is to be transmitted; however, such modulation effects, i.e. modulates, continuous wave energy which may be being transmitted in a different beam. These intermodulation effects, however, very often adversely distort the continuous wave energy signal being transmitted.

SUMMARY OF THE INVENTION

With this background of the invention in mind it is therefore an object of this invention to provide an improved multi-beam array antenna system.

It is a further object of this invention to provide an improved multi-beam array antenna system adapted to produce, simultaneously, independent beams of continuous wave (CW) and pulsed radio frequency energy.

It is a further object of this invention to provide an improved multi-beam array antenna system of the type mentioned above having minimum size, weight and power requirements.

It is still a further object of this invention to provide an improved multi-beam array antenna system of the type just mentioned having minimum intermodulation between the pulsed radio frequency energy and the continuous wave (CW) energy.

These and other objects of the invention are attained generally by providing a multi-beam array antenna comprising first and second beam forming networks, an array of antenna elements coupled to the first beam forming network and a portion of such antenna elements coupled to the second beam forming network, a plurality of radio frequency amplifiers disposed between the antenna elements and the first and second beam forming network, the plurality of antenna elements being coupled to the first beam forming network through the plurality of amplifiers and the portion of the antenna elements coupled to the second beam forming network through a portion of the radio frequency amplifiers.

In a preferred embodiment of the invention a first form of modulated radio frequency energy (i.e. pulse modulated energy) is fed to the first beam forming network and a second form of modulated radio frequency energy (i.e. unmodulated or continuous wave energy) is fed to the second beam forming network. During transmission of the continuous wave energy only the portion of the amplifiers coupled to the second beam forming network is powered and only during transmission of pulse modulated radio frequency energy is the entire plurality of radio frequency amplifiers supplied power. With such arrangement the power required for the multibeam array antenna system is reduced and the activation of the radio frequency amplifiers which are used to transmit pulsed energy produces minimum intermodulation of the continuous wave energy being transmitted.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENTS

Figure 1:
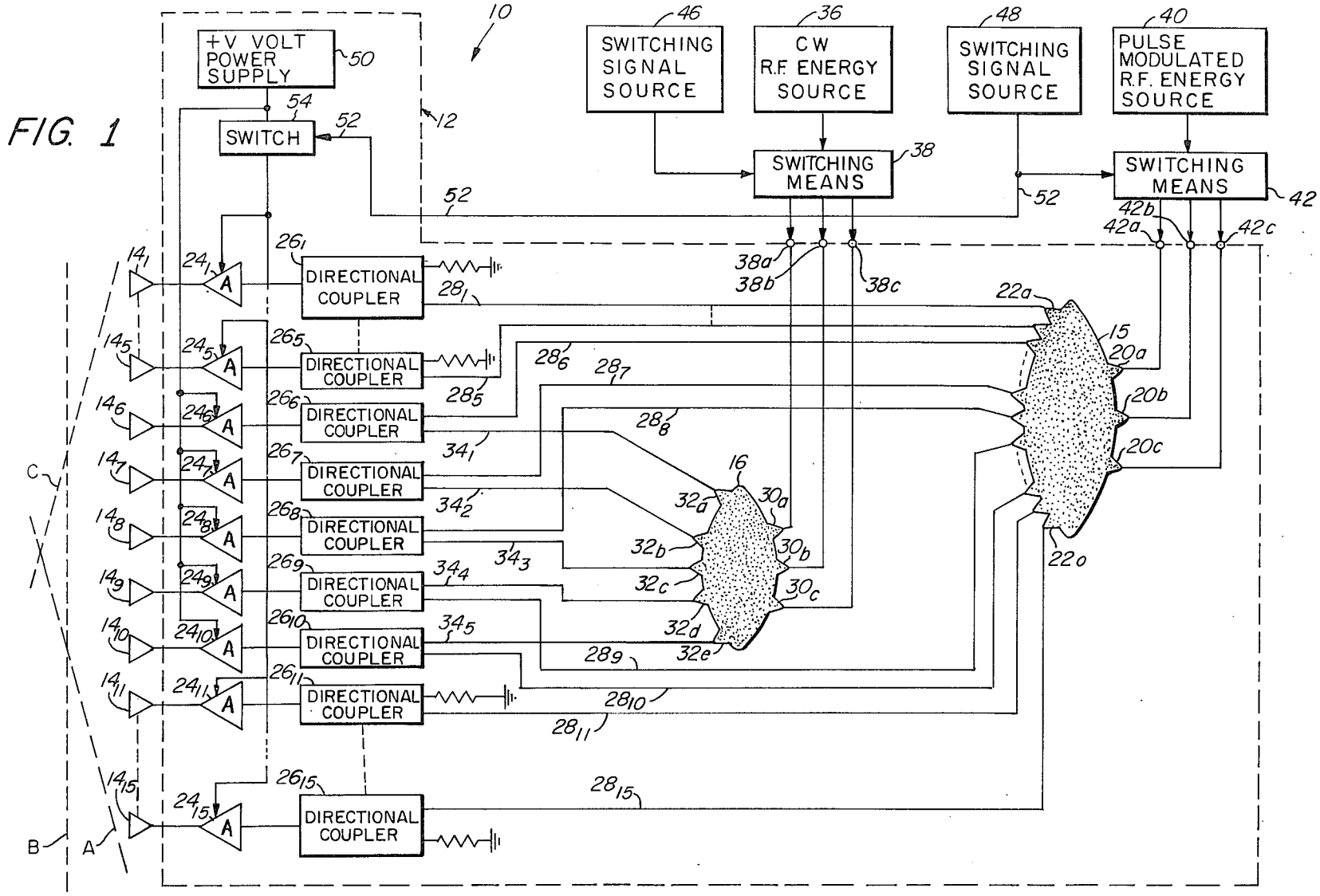
FIG. 1 is a block diagram of a multi-beam array antenna system according to the invention.

Referring now to FIG. 1, a multibeam array antenna system 10 is shown to include a beam forming section 12 coupled to a plurality of, here fifteen, antenna elements $14_1$–$14_{15}$ arranged in a linear array, as shown. Such beam forming network section 12 includes a first beam forming network, here a radio frequency parallel plate lens 15, and a second beam forming network, here a radio frequency parallel plate lens 16, such lenses 15, 16 here being of the type described in U.S. Pat. Nos. 3,761,936 and 3,715,749 mentioned above. For simplicity it has been selected to show a multi-beam array antenna system for producing three simultaneously existing beams, although it should be recognized that a greater number would ordinarily be desired. Thus, radio frequency lens 15 has three input ports 20*a*, 20*b*, 20*c*, and, here, fifteen output ports 22*a*–22*o*, as shown. Such output ports 22*a*–22*o* are coupled to the antenna elements $14_1$–$14_{15}$ through radio frequency amplifiers $24_1$–$24_{15}$ (here traveling wave tube amplifiers) and conventional directional couplers $26_1$–$26_{15}$ (here 3 db couplers), via transmission lines $28_1$–$28_{15}$, as shown. Likewise, radio frequency lens 16 has three input ports 30*a*, 30*b*, 30*c*, and, here, five output ports 32*a*–32*e*. Output ports 32*a*–32*e* are coupled to antenna elements $14_6$–$14_{10}$ through radio frequency amplifiers $24_6$–$24_{10}$ and directional couplers $26_6$–$26_{10}$ via transmission lines $34_1$–$34_5$, as shown. Directional couplers $26_1$–$26_5$ and $26_{11}$–$26_{15}$ have one input port coupled to ground through a terminating resistor (not numbered) as indicated and a second input port coupled to transmission lines $28_1$–$28_5$ and $28_{11}$–$28_{15}$, respectively, as indicated. Directional couplers $26_6$–$26_{10}$ have one input port coupled to transmission lines $28_6$–$28_{10}$, respectively, and the other one of their input ports coupled to transmission lines $34_1$–$34_5$, respectively, as indicated. The disposition of the antenna elements, the lengths of each one of the transmission lines $28_1$–$28_{15}$ and $34_1$–$34_5$ and the configuration of the radio frequency lenses 15, 16 are selected so that the electrical length of the paths from any one of the input ports 20*a*–20*c* to points along a planar wavefront of radio frequency energy in any one of three beams thereof are the same, and likewise so that the electrical length of the paths from input ports 30*a*–30*c* to points along a planar wavefront of radio frequency energy in any one of the three beams thereof are the same. That is, for lens 15, the length of the electrical path from input port 20*a* to planar wavefront A is the same for radio frequency energy emanating from any one of the antenna elements $14_1$–$14_{15}$; the length of the electrical path from input port 20*b* to any point on planar wavefront B is the same; and the length of the electrical path from input port 20*c* to any point on planar wavefront C is the same. Likewise, for lens 16 the length of the electrical path from input port 30*a* to planar wavefront A is the same; the length of the electrical path from input port 30*b* to any point on planar wavefront B is the same; and the length of the electrical path from input port 30*c* to any point on planar wavefront C is the same. Further energy fed to directional couplers $26_1$–$26_{15}$ from lens 15 is reduced 3 db by such directional couplers $26_1$–$26_{15}$ and energy fed to directional couplers $26_6$–$26_{10}$ from lens 16 is also reduced 3 db by such couplers.

Beam forming network section 12 is coupled to a continuous wave (CW) radio frequency energy source 36 through a switching means 38 and is also coupled to a pulse modulated radio frequency energy source 40 through a switching means 42, as indicated. The switching means 38, 42 may be of any conventional design, as a suitable network of p-i-n diodes arranged to couple radio frequency energy fed thereto from sources 36, 40, respectively, to selected one or ones of three input ports 38*a*, 38*b*, 38*c* and 42*a*, 42*b*, 42*c* in response to switching signals produced by switching signal sources 46, 48. That is, in response to control signals from switching signal source 46, switching means 38 operates to couple continuous wave radio frequency energy from source 36 to a selected one or ones of input ports 38*a*–38*c* and hence to a selected one or ones of input ports 30*a*–30*c* of radio frequency lens 16. It is noted that radio frequency amplifiers $24_6$–$24_{10}$ are powered by a +V volt power supply 50. Therefore, in response to signals from switching source 46 continuous wave radio frequency signals are transmitted along a selected one or ones of the wavefronts A and/or B and/or C.

In order to transmit pulsed radio frequency signals a power switching signal is produced on line 52 by the switching signal source 48. The signal on line 52 actuates switch 54 to couple radio frequency amplifiers $24_1$–$24_5$ and $24_{11}$–$24_{15}$ to the +V volt power supply 50. That is, the +V power supply 50 is required to supply power to radio frequency amplifiers $24_1$–$24_5$ and $24_{11}$–$24_{15}$ only during the time interval during which pulse modulated radio frequency signals are to be transmitted. During such time interval switching means 42, in response to switching signals from source 48, couples pulse modulated energy from source 40 to a selected one or ones of the input ports 42*a*–42*c* and hence to a selected one or ones of input ports 20*a*–20*c* of lens 15 to enable transmission of pulse modulated energy along a selected one or ones of the wavefronts A and/or B and/or C. It is noted, therefore, that pulse modulated and continuous wave energy may be transmitted along different wavefronts or along the same wavefront. It is also noted that the capacity of the +V volt power supply 50 may be reduced because such supply powers amplifiers $24_1$–$24_5$ and $24_{10}$–$24_{15}$ only during the interval of time when pulse modulated energy is being transmitted. Further, intermodulation between pulsed and continuous wave energy is minimized because the radio frequency amplifiers $24_6$–$24_{10}$, which are used to amplify the continuous wave energy, are not affected when switch 50 is actuated by the control signal on line 52.

Figure 2:
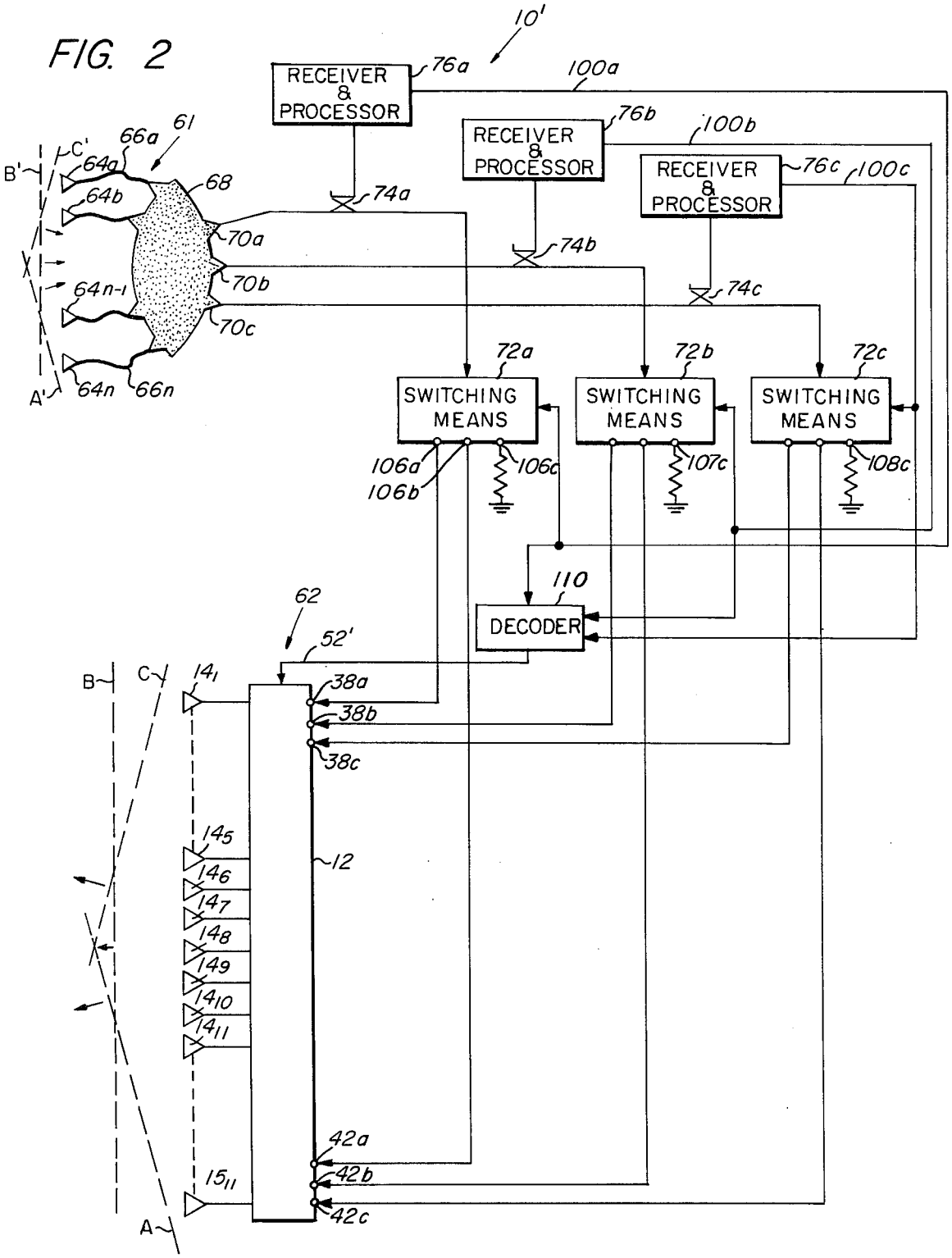
FIG. 2 is a block diagram of an alternative embodiment of a multi-beam array antenna system according to the invention.

Referring now to FIG. 2, a multi-beam array antenna system 10′ is shown to include a receiving multi-beam array antenna 61 and a transmitting multi-beam array antenna 62. Again, for simplicity it has been selected to show array antennas having three simultaneously existing beams, it being recognized that a greater number of beams would ordinarily be desired. Thus, receiving multi-beam array antenna 61 here includes a linear array of antenna elements 64*a*–64*n*, a similar plurality of transmission lines 66*a*–66*n*, a parallel plate radio frequency lens 68 and three output ports 70*a*–70*c* disposed along an arc of best focus of the parallel plate lens (it is noted that the radio frequency lens 68 is equivalent in construction to lenses 15, 16 shown in FIG. 1). The disposition of the antenna elements 64*a*–64*n*, the length of each one of the transmission lines 66*a*–66*n* and the configuration of the lens 68 are selected so that the electrical length of the path from any one of the output ports 70a–70c to points along a planar wavefront in any one of three beams thereof are the same. That is, the length of the electrical path from port 70a to planar wavefront A′ is the same for radio frequency energy entering any one of the antenna elements 64a–64n; the length of the electrical path from port 70b to any point on planar wavefront B′ is the same and the length of the electrical path from feed port 70c to any point on planar wavefront C′ is the same.

Considering first radio frequency energy in the beam represented by wavefront A′, it will be noted that portions of such energy fall successively on antenna elements 64n through 64a and that each one of such succeeding portions will be guided through a different one of the transmission lines 66n through 66a to radio frequency lens 68. The spacing between successive antenna elements, the length of each transmission line and the shape of the parallel plate lens is such that each portion of the radio frequency energy in the beam represented by wavefront A′ is "in phase∞ at port 70a, while each portion of such energy arriving at ports 70b, 70c is "out of phase". That is, the vectorial addition of the "in phase" portions results in a maximum composite signal at port 70a and the vectorial addition of the "out of phase" portions results in composite signals at ports 70b, 70c which are substantially less, say in the order of 14 db down, than the maximum composite signal.

Similarly, portions of the radio frequency energy in the beams represented by wavefront B′, upon passing through antenna elements 64a–64n, transmission lines 66a–66n and lens 68 are "in phase" at port 70b and out-of-phase at ports 70a, 70c. Still similarly, portions of the radio frequency energy in the beam represented by wavefront C′ are "in phase" at port 70c and "out of phase" at ports 70a, 70b.

The radio frequency energy received at ports 70a, 70b, 70c are fed to switching means 72a, 72b, 72c, respectively, and a portion of such energy is fed to receiver and processors 76a–76c via directional couplers 74a–74c, respectively, as shown. Each one of the receiver and processors 76a–76c are identical in construction and the details thereof will be described in connection with FIG. 3 and FIGS. 4A–4H. Suffice it to say, here, however, that the receiver and processors 76a–76c produce control signals on buses 100a–100c, respectively. Such control signals indicate whether a signal is "being received", whether such signal is a pulse modulated signal, or whether such signal is a continuous wave signal. The control signals on buses 100a–100c are fed to switching means 72a–72c, respectively, as indicated.

Switching means 72a, 72b, 72c, here of any conventional design, such as a suitable network of p-i-n diodes, couple radio frequency energy fed thereto from ports 70a, 70b, 70c, respectively, to one of three output ports of each one of the switching means 72a–72c. In particular, with regard to switching means 72a, if the control signal on bus 100a indicates that no signal is being received, the port 70a is coupled to output port 106c and hence to ground through a suitable load resistor (not numbered), if the control signal on bus 100a indicates that the signal received at port 70a is pulse modulated energy, port 70a is coupled to port 106b and hence the pulse modulated energy at port 70a is fed to port 42a of beam forming network 12 (described in detail in connection with FIG. 1), and if the control signal on bus 100a indicates that the signal received at port 70a is a continuous wave signal such port is coupled to port 106a and hence the continuous wave energy is fed to port 38a of beam forming network section 12. Likewise, switching means 72b and 72c operate similarly in response to control signals on buses 100b, 100c, respectively, so that if no signal is detected at port 70b, port 107c is coupled to ground through a suitable load resistor (not numbered), if the signal at port 70b is a pulse modulated signal such signal is fed to port 42b of beam forming network section 12, if the signal at port 70b is a continuous wave signal such signal is fed to port 38b of beam forming network section 12, if no signal is detected at port 70c, port 108c is coupled to ground through a suitable load resistor (not numbered), if a pulse modulated signal is detected at port 70c such signal is fed to port 42c of beam forming network section 12, and if a continuous wave signal is detected at port 42c such signal is fed to port 38c of beam forming network section 12. Still further, the buses 100a–100c are fed to a decoder 110. Such decoder 110 is of any conventional design and produces a control signal on line 52′ indicative of whether a pulse modulated signal is being detected at any one of the three ports 70a–70c. When a pulse modulated signal is detected the control signal on line 52′ actuates switch 54 (FIG. 1) to couple the +V volt power supply 50 to radio frequency amplifiers $24_1$–$24_5$ and $24_{11}$–$24_{15}$ as described in connection with FIG. 1. In this manner when a continuous wave signal is detected it is retrodirected by lens 16, powered amplifiers $24_6$–$24_{10}$ and antenna elements $14_6$–$14_{10}$. However, only when a pulse modulated signal is detected are amplifiers $24_1$–$24_5$ and $24_{11}$–$24_{15}$ powered so that the pulse modulated signal is retrodirected via lens 15, radio frequency amplifiers $24_1$–$24_{15}$ and antenna elements $14_1$–$14_{15}$.

Figure 3:
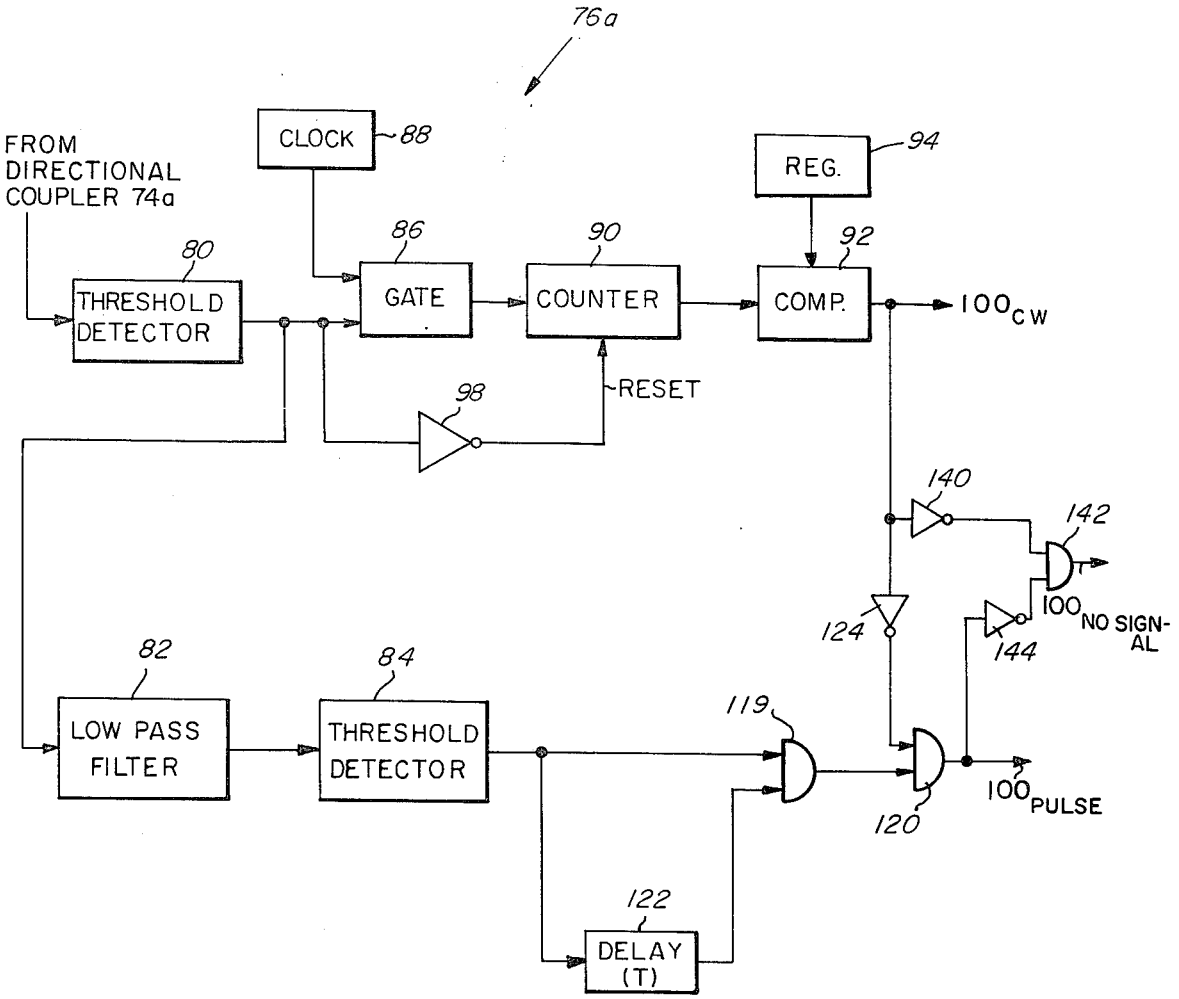
FIG. 3 is a block diagram of a receiver and processor used in the system shown in FIG. 2.
Figures 4A, 4B, 4C, 4D, 4E, 4F, 4G, 4H:
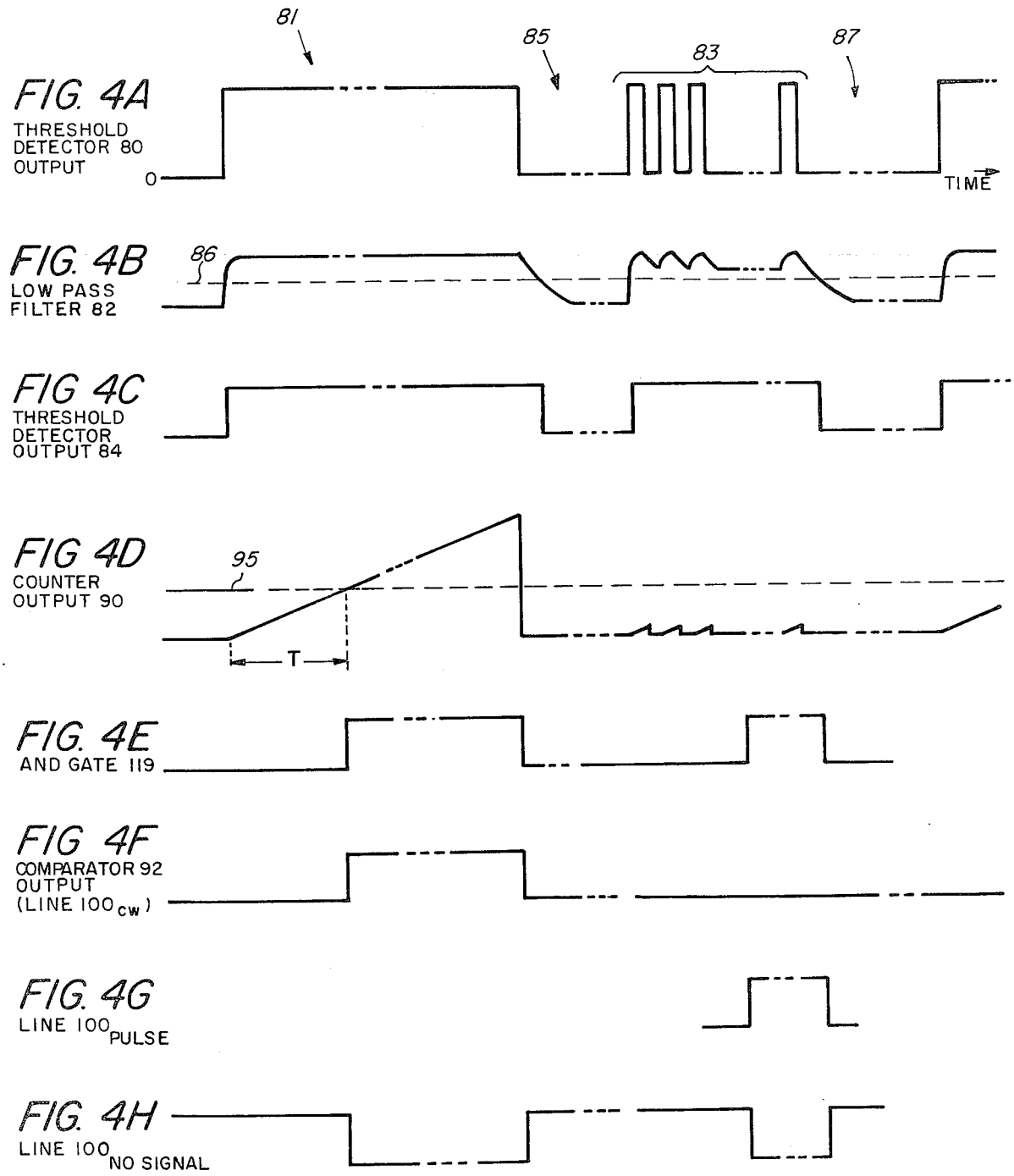
FIGS. 4A–4H are time histories useful in understanding the receiver and processor shown in FIG. 3.

Referring now to FIG. 3, an exemplary one of the receiver and processors 76a–76c, here receiver and processor 76a, is shown to include a threshold detector 80 fed by the output of directional coupler 74a (FIG. 2). The detector 80 is of any conventional design to produce a high signal (i.e. logical 1) when the level of the signal at port 70a is greater than a pedetermined level and to produce a low signal (i.e. logical 0) when the level of the signal at port 70a is less than or equal to the predetermined level. The output of threshold detector 80 may, in typical operation, be as shown in FIG. 4A. Here during the period of time 81 a continuous wave signal appears at port 70a during the period of time 83 a pulse modulated signal appears at port 70a and during periods of time 85, 87 "no signal" appears at port 70a. The output of detector 80 is fed, inter alia, to a low pass filter 82. The low pass filter 82 smooths the output of detector 80 as shown in FIG. 4B. The time constant (i.e. bandwidth) of low pass filter 82 is selected in accordance with the maximum expected interval between pulses of a pulse modulated signal. In this way the level of the output of low pass filter 82 will not fall appreciably during the time interval between such pulses as indicated in FIG. 4B. The low pass filter 82 is fed to a threshold detector 84. Threshold detector 84 produces a high signal (i.e. logical 1) when the output of low pass filter 82 is greater than or equal to a predetermined level as indicated by dotted line 86 in FIG. 4B and produces a low signal when the output of low pass filter 82 is less than such level. The output of threshold detector 84 is shown in FIG. 4C.

The output of threshold detector 80 is also fed to a gate 86. Also fed to gate 86 is a clock pulse generator 88.

When the output of threshold detector 80 is high, clock pulses pass through gate 86 and pass to counter 90. The output of counter 90 is fed to a comparator 92. Also fed to comparator 92 is a register 94. The contents stored in register 94 represent a period of time, such period of time, T, here considered as the criteria for determining whether a detected signal at port 70*a* (FIG. 1) is a pulse modulated signal or a continuous wave signal. In particular, if such detected signal has a time duration greater than or equal to the period of time T such detected signal is considered as a continuous wave signal. When the contents of counter 90 are greater than or equal to the contents stored in register 94 (i.e. the detected signal is considered as a continuous wave signal) the output of comparator 92 goes high and when the contents of counter 90 are less than the contents stored in register 94 the output of comparator 92 is low. It is also noted that when the output of threshold detector 80 is low, inverter 98 produces a high signal to reset counter 90. Hence, referring also to FIG. 4D the output of counter 90 is shown. The contents stored in register 94 are represented by dotted line 95. The output of comparator 92 is shown in FIG. 4F.

Referring again also to FIG. 3, the output of threshold detector 84 is fed to an AND gate 119 and a conventional delay network 122, as shown. Delay network 122 delays the output of threshold detector 84 a period of time T. The output of delay network 122 is also fed to AND gate 119. The effect of AND gating the outputs of threshold detector 84 and delay network 122 in AND gate 119 is to produce a gating signal for AND gate 120 as indicated in FIG. 4E. The output of comparator 92 is fed to AND gate 120 through inverter 124. Therefore, the output of AND gate 120 is a binary signal, and when such signal is high, detection of a pulse modulated signal is indicated as shown in FIG. 4G. The output of comparator 92 is fed via inverter 140 to AND gate 142 and the output of AND gate 120 is fed via inverter 144 to AND gate 142, as shown. When the output of AND gate 142 goes high a "no detected signal" condition exists as shown in FIG. 4H. The outputs of comparator 92, AND gate 142 and AND gate 120 appear on lines $\mathbf{100}_{CW}$, $\mathbf{100}_{no\ signal}$ and $\mathbf{100}_{pulse}$, respectively, as indicated. Such lines constitute bus 100*a* (FIG. 2). Therefore, referring also to FIG. 2, when line $\mathbf{100}_{CW}$ is high, switching means 72*a* couples port 70*a* to port 38*a*, when line $\mathbf{100}_{pulse}$ is high, switching means 72*a* couples port 70*a* to port 42*a* and when line $\mathbf{100}_{no\ signal}$ is high, switching means 72*a* couples port 70*a* to ground. Further, lines $\mathbf{100}_{pulse}$ of the receiver and processors 76*a*, 76*b*, 76*c* are effectively OR gated in decoder 110 to produce a high signal on line 52' thereby to actuate switch 54 (FIG. 1) and couple radio frequency amplifiers $\mathbf{24}_1$–$\mathbf{24}_5$ and $\mathbf{24}_{11}$–$\mathbf{24}_{15}$ to the +V volt power supply 50 when a pulse modulated signal is detected.

Having described preferred embodiments of the invention, it will now become apparent to one of skill in the art that other embodiments incorporating these concepts may be used. For example, the antenna elements may be formed in a two dimensional array instead of the linear array shown. It is felt, therefore, that this invention should not be restricted to its disclosed embodiment, but rather should be limited only by the spirit and scope of the appended claims.

What is claimed is:

1. A multibeam array antenna comprising:

(a) an array of antenna elements;

(b) a first beam forming network coupled to each of the antenna elements in the array;

(c) a second beam forming network coupled to a portion of the antenna elements;

(d) a plurality of radio frequency amplifiers, each one of the antenna elements in the array being coupled to the first beam forming network through a corresponding one of such plurality of radio frequency amplifiers and each one of the antenna elements in the portion of the antenna elements being coupled to the second beam forming network through a corresponding one of the portion of the plurality of radio frequency amplifiers;

(e) means for coupling a power supply to the portion of the plurality of radio frequency amplifiers;

(f) switching means for coupling the remaining ones of the plurality of radio frequency amplifiers to the power supply selectively in accordance with a control signal such switching means including means for coupling the plurality of amplifiers to the power supply during transmission of one type of modulated radio frequency energy and for coupling only the portion of radio frequency amplifiers to the power supply during transmission of a different type of modulated radio frequency energy.

2. A multibeam array antenna system comprising:

(a) an array of antenna elements;

(b) a first radio frequency lens coupled to each one of the antenna elements in the array thereof, such first radio frequency lens having a first set of feed ports each one of such first set of feed ports being associated with a different one of a corresponding plurality of beams of radio frequency energy;

(c) a second radio frequency lens coupled to a portion of the antenna elements in the array thereof, such second radio frequency lens having a second set of feed ports each one of such second set of feed ports being associated with a different one of a corresponding plurality of beams of radio frequency energy and being operative independently of the first set of feed ports; and (d) means adapted to couple a first type of modulated signals to the first set of feed ports and a different type of modulated signals to the second set of feed ports.

3. The antenna system recited in claim 2 including a plurality of amplifiers coupled between each one of the antenna elements and the first radio frequency lens, a portion of such amplifiers being also coupled between the second radio frequency network and the portion of the antenna element coupled thereto.

4. The antenna system recited in claim 3 including means for powering the plurality of amplifiers when the first type of modulated signals is coupled to the first radio frequency network and for powering the portion of the amplifiers when the different type of modulated signals is coupled to the second radio frequency network.

5. An array antenna system comprising:

(a) a plurality of beam forming networks each one of such networks having a plurality of independently fed input ports;

(b) a plurality of antenna elements;

(c) means for coupling each one of the beam forming networks to different sets of the antenna elements, each one of such sets having a common portion of the antenna elements; and (d) transmitter means adapted to couple different types of modulated signals to the plurality of independently fed input ports of the different ones of the plurality of beam forming networks.

* * * * *